US006715691B2

(12) United States Patent
Park et al.

(10) Patent No.: US 6,715,691 B2
(45) Date of Patent: Apr. 6, 2004

(54) PRESSURE DISTRIBUTION AND REGULATION IN HIGH-RISE BUILDINGS

(76) Inventors: Jung-Ro Park, 708-801 Shindonga, Apt. 325, Noryangjin-dong, Dongjak-gu, Seoul (KR); Jung-Hwan Park, Inha technical college, 253 Yonghyun-dong, Nam-gu, Inchon (KR); Young-Tack Choi, 797-7 MiRae Build., Yeoksam-dong, Kangnam-gu, Seoul (KR)

( * ) Notice: Subject to any disclaimer, the term of this patent is extended or adjusted under 35 U.S.C. 154(b) by 6 days.

(21) Appl. No.: 10/117,631

(22) Filed: Apr. 4, 2002

(65) Prior Publication Data

US 2004/0011505 A1 Jan. 22, 2004

(51) Int. Cl.[7] ..... F24D 3/02

(52) U.S. Cl. ..... 237/8 A; 62/185; 165/244; 237/63

(58) Field of Search ..... 237/63, 8 R, 8 A; 165/218, 244; 62/185

(56) References Cited

U.S. PATENT DOCUMENTS 1,189,806 A * 7/1916 Gibson ..... 237/8 R
3,351,128 A * 11/1967 Barnd ..... 237/8 R
5,022,231 A * 6/1991 Martinez, Jr. ..... 237/63 X

* cited by examiner

*Primary Examiner*—William Wayner
(74) *Attorney, Agent, or Firm*—Samuel Lee

(57) ABSTRACT

A multi-stage pressure distribution and pressure regulation system. The system includes at least one heating and cooling load having a supply side and a return side, a heat source supply system for supplying thermo-fluid to the at least one heating and cooling load, and a booster pumping system including at least one booster pump for transferring the thermo-fluid from the heat source supply system to the supply side of the at least one heating and cooling load for maintaining a predetermined head pressure. The multi-stage system also includes at least one pressure regulating system including at least one pressure reducing and sustaining device for reducing the pressure of the thermo-fluid flowing from the return side of the at least one heating and cooling load and sustaining the pressure at the predetermined head pressure.

20 Claims, 8 Drawing Sheets

PRESSURE DISTRIBUTION AND REGULATION IN HIGH-RISE BUILDINGS

BACKGROUND

The present invention relates to high-rise buildings. More particularly, the invention relates to pressure distribution and regulation in such high-rise buildings.

In a high-rise building, water pressure within piping units of thermal equipment, such as a refrigerator, a boiler and a heat exchanger, may be directly associated with the structural integrity of the building. For example, in buildings with more than about 20 stories, pressure in the piping units in excess of about 10 kg/cm$^2$ may cause weight and vibration problems. For safety reasons, this may require the use of steel pipe for pressure service (SPPS). Furthermore, this may also require the use of stronger and more expensive material during construction to meet the building code. Accordingly, the thermal equipment is generally distributively installed on the intermediate floors and/or on the top floor of the building to stably and accurately control the pressure within the piping units. However, as the height of the building increases, distributive installation proportionately increases the floor space used to house thermal equipment. Moreover, the distribution of the thermal equipment may increase the complexity of the pressure control system.

SUMMARY

In one aspect, a multi-stage pressure distribution and pressure regulation system is disclosed. The system includes at least one heating and cooling load having a supply side and a return side, a heat source supply system for supplying thermo-fluid to the at least one heating and cooling load, and a booster pumping system including at least one booster pump for transferring the thermo-fluid from the heat source supply system to the supply side of the at least one heating and cooling load for maintaining a predetermined head pressure. The multi-stage system also includes at least one pressure regulating system including at least one pressure reducing and sustaining device for reducing the pressure of the thermo-fluid flowing from the return side of the at least one heating and cooling load and sustaining the pressure at the predetermined head pressure.

In another aspect, a method for distributing fluid pressure acting on piping units of a building is disclosed. The method includes providing booster pumps in multiple stages at appropriate intermediate floors of the building to build sufficient pressure on a supply side of heating and cooling loads, and providing pressure reducing valves in multiple stages at appropriate intermediate floors of the building to reduce the pressure on a return side of the heating and cooling loads.

DETAILED DESCRIPTION

In recognition of the above-stated problems associated with prior art designs of high-rise buildings, alternative embodiments for distributing and regulating pressure in the piping units of thermal equipment are described. In particular, the pressure in the piping units is stably maintained at a relatively constant value at substantially all floors of the building. Furthermore, the piping units are configured into vertically-zoned areas so that the pressure may be appropriately controlled within a certain range. In the supply side, the staged booster pumps pressurize and supply the piping units to circulate the thermo-fluid. To prevent the upstream side pressure from acting on the downstream side pressure, check valves are used to regulate each stage. In the return side, pressure within the piping units is controlled by employing a pressure reducing and sustaining device. Such a device operates to isolate a main device when the upstream side pressure becomes lower than a predetermined pressure and to prevent backflow by cutting off the main device when the downstream side pressure becomes higher than the predetermined pressure. This pressure maintaining function allows pressure within the piping units to be stably maintained within a range of design. Consequently, for purposes of illustration and not for purposes of limitation, the exemplary embodiments of the invention are described in a manner consistent with such use, though clearly the invention is not so limited.

Figure 1A:
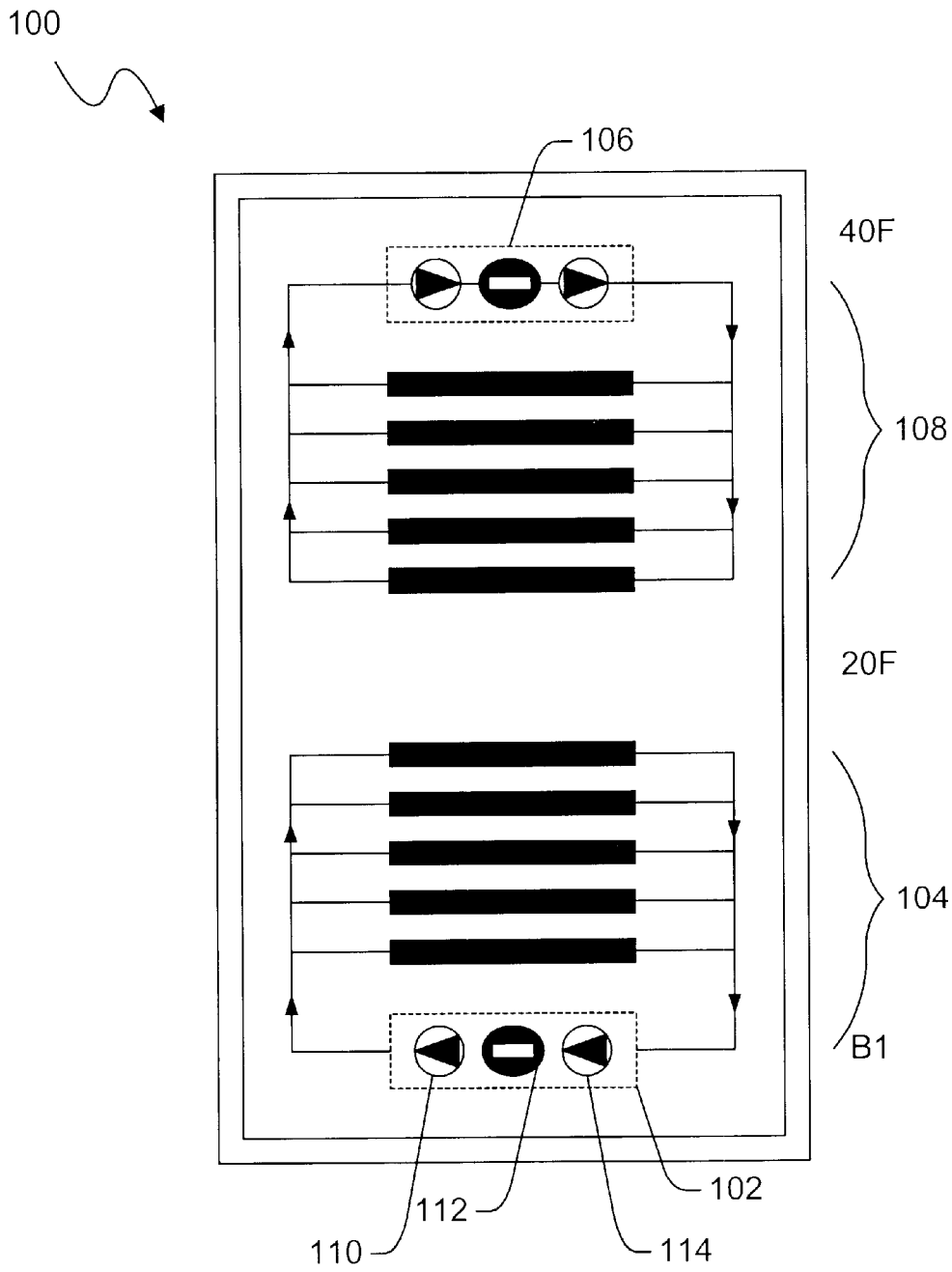
FIG. 1A (PRIOR ART)
FIG. 1 is a systematic diagram of heating and air conditioning piping units of an embodiment according to the present invention.

FIG. 1A illustrates a flow diagram of a conventional piping system 100 for an approximately 40-story building. The piping system 100 includes a first thermal equipment unit 102 in the basement of the building, and a second thermal equipment unit 106 in the top floor of the building. Furthermore, each thermal equipment unit 102 or 104 may include a pair circulation/boost pumps 110, 114 and at least one thermal equipment 112 such as a refrigerator, a boiler, or a heat exchanger. The piping system 100 may also include heating and cooling loads 104, 108 so that each floor of the building includes at least one load. The diagram indicates the direction of the thermo-fluid flowing from the thermal equipment unit 102, 106 to the loads 104, 108. The diagram also indicates the direction of the thermo-fluid flowing out the loads 104, 108. Thus, it can be seen that the floor space occupied by the thermal equipment units on a 40-story building may be about double the space occupied by the thermal equipment units on a 20-story building.

Figure 1B:
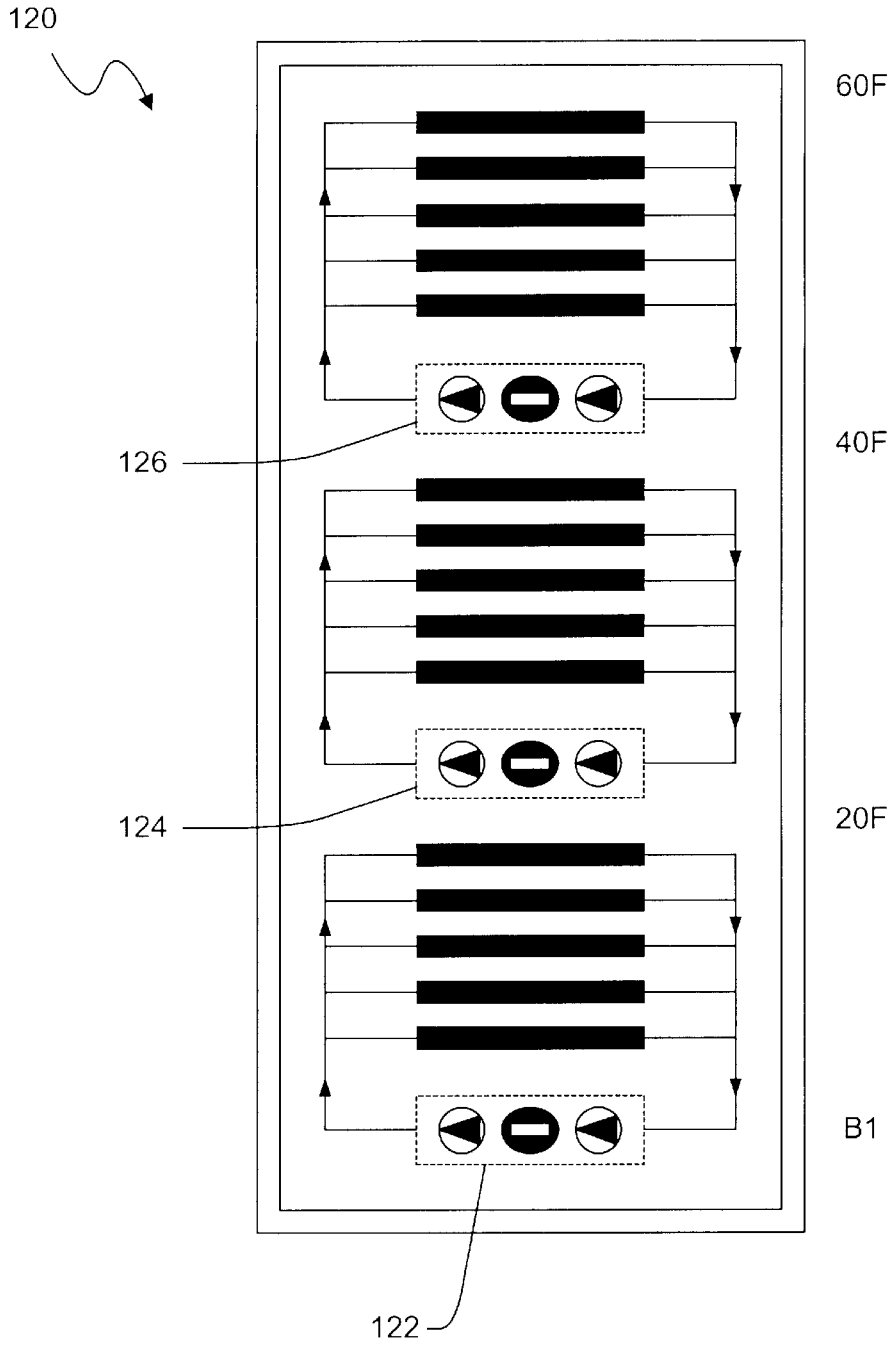
FIG. 1B (PRIOR ART)

FIG. 1B illustrates a flow diagram of another conventional piping system 120 for an approximately 60-story building. The piping system 120 includes a first thermal equipment unit 122 in the basement of the building, a second thermal equipment unit 124 in the middle floor (e.g., 20th floor) of the building, and a third thermal equipment unit 126 in the top floor of the building. Thus in this system 110, it can be seen that the floor space occupied by the thermal equipment units on a 60-story building may be about three times the space occupied by the thermal equipment units on a 20-story building.

Figure 1C:
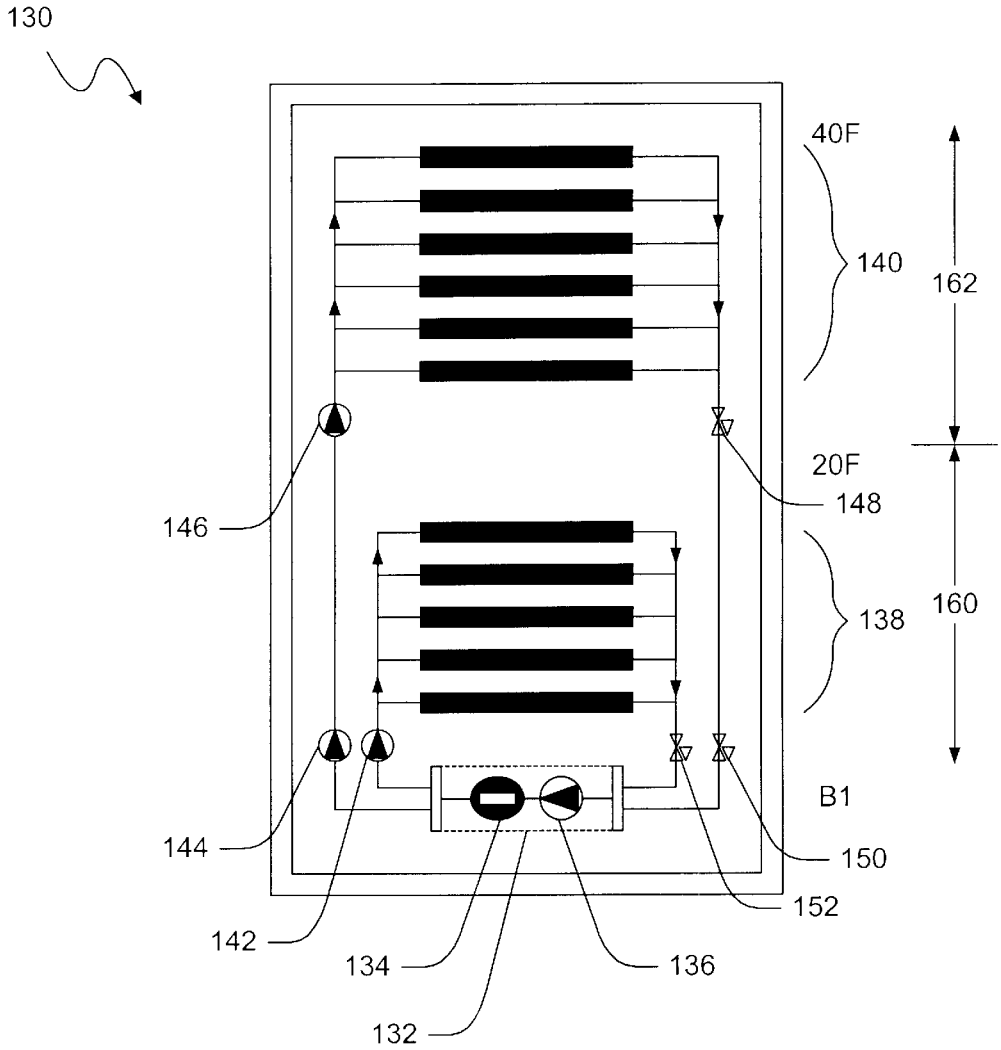

FIG. 1C illustrates a flow diagram of a piping system 130 for an approximately 40-story building in accordance with an embodiment of the invention. However, the piping system 130 configured in the illustrated embodiment may be used as a piping system for a building of any height up to about 40 stories high.

In the illustrated embodiment, the piping system 130 includes only one thermal equipment unit 132 in the basement of the building. The thermal equipment unit 132 may include a circulation/boost pump 136 and a thermal equipment 134 such as a refrigerator, a boiler, or a heat exchanger. The piping system 130 may also include heating and cooling loads 138, 140 so that each floor of the building includes at least one load.

Since thermal equipment unit(s), generally located in the middle floor of the building is eliminated, the building may be divided into several stages where high water pressure may be effectively controlled. In the illustrated embodiment, the first stage 160 generally includes bottom twenty floors with load 138, while the second stage 162 generally includes top twenty floors with load 140. Hence, the pressure in the first stage 160 may be controlled by a circulation/boost pump 142 in the supply side, and a pressure regulator 152 in the return side. In some embodiments, the pressure regulator 152 may enable both pressure reducing and pressure sustaining functions. Moreover, the pressure in the second stage 162 may be controlled by a pair of circulation/boost pumps 144, 146 in the supply side, and a pair of pressure regulators 148, 150 in the return side.

Figure 1D:
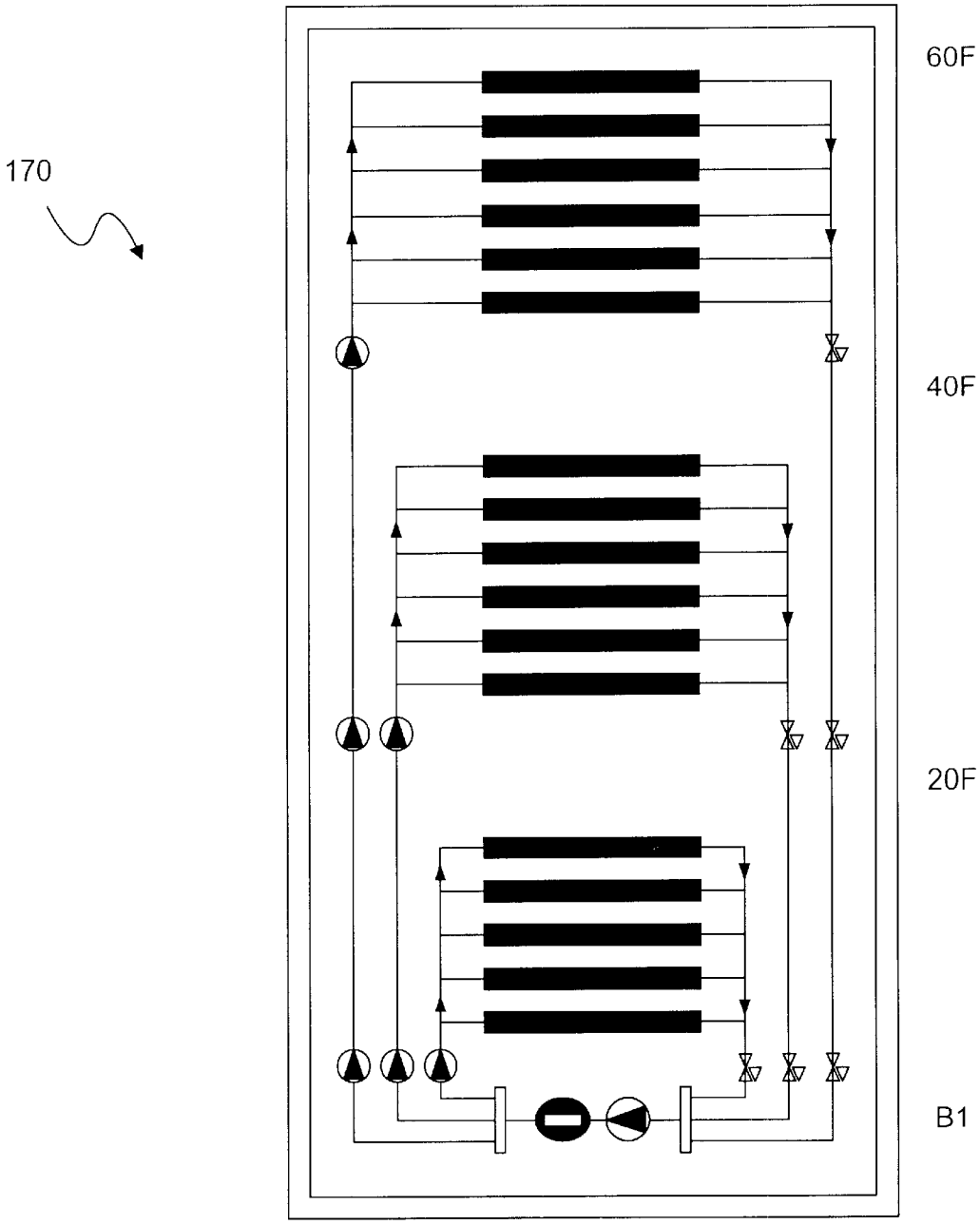

FIG. 1D illustrates a flow diagram of a piping system 170 for an approximately 60-story building in accordance with an embodiment of the invention. It can be seen that this embodiment is an extension of the embodiment shown in FIG. 1C. Thus, by using circulation/boost pumps and pressure regulators, large floor space and operational complexity that are associated with having at least one thermal equipment unit every 20 or so floors may be substantially reduced. In some embodiments, the circulation/boost pumps and pressure regulators may be coupled directly to the thermo-fluid lines of the piping units. Heights of respective stages may be appropriately adjusted according to the variations in the piping material, building conditions, and/or other similar parameters.

Figure 2:
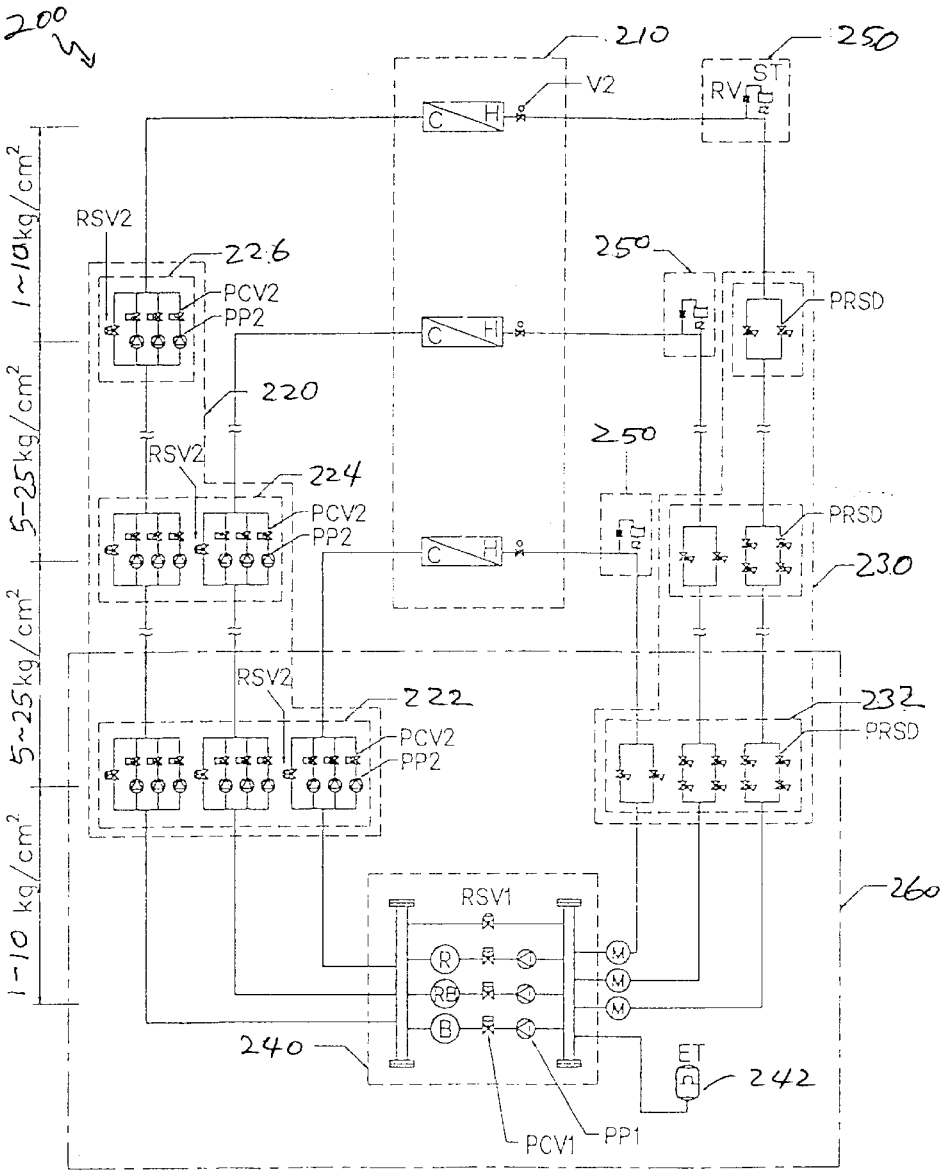
FIG. 2 is a conceptual view of a system for controlling the system of the present invention.

FIG. 2 shows a detailed block diagram of a multi-stage pressure distribution and regulation system 200 according to an embodiment of the invention. The system 200 includes heating and cooling loads 210, a booster pumping system 220, and a pressure regulating system 230. Furthermore, the multi-stage pressure distribution and regulation system 200 is coupled to a heat source supply system 240 through piping units for controlling water pressure (e.g., air conditioning water pressure). Each of the heating and cooling loads 210, the booster pumping system 220, and the pressure regulating system 230 may include multiple stages. The piping units may employ steel pipes, copper pipes, stainless steel pipes, or other similar material.

The heating and cooling loads 210 may include an air handling unit (AHU), a fan coil unit (FCU), a convector, and other similar units. In the illustrated embodiment, the heat source supply system 240 includes thermal equipment, such as a refrigerator (R), a boiler (B), a water cooling/heating device (RB). The system 240 may also include a first circulation pump (PP1) for circulating and driving thermo-fluid, a pump control valve (PCV1) interlocked with the first circulation pump (PP1), and a pressure relieving and sustaining valve (RSV1). In an alternative embodiment, the heat source supply system 240 may comprise a district heat source supply system, such as a combined heat and power plant, for supplying thermo-fluid from the exterior of the building.

Figure 3:
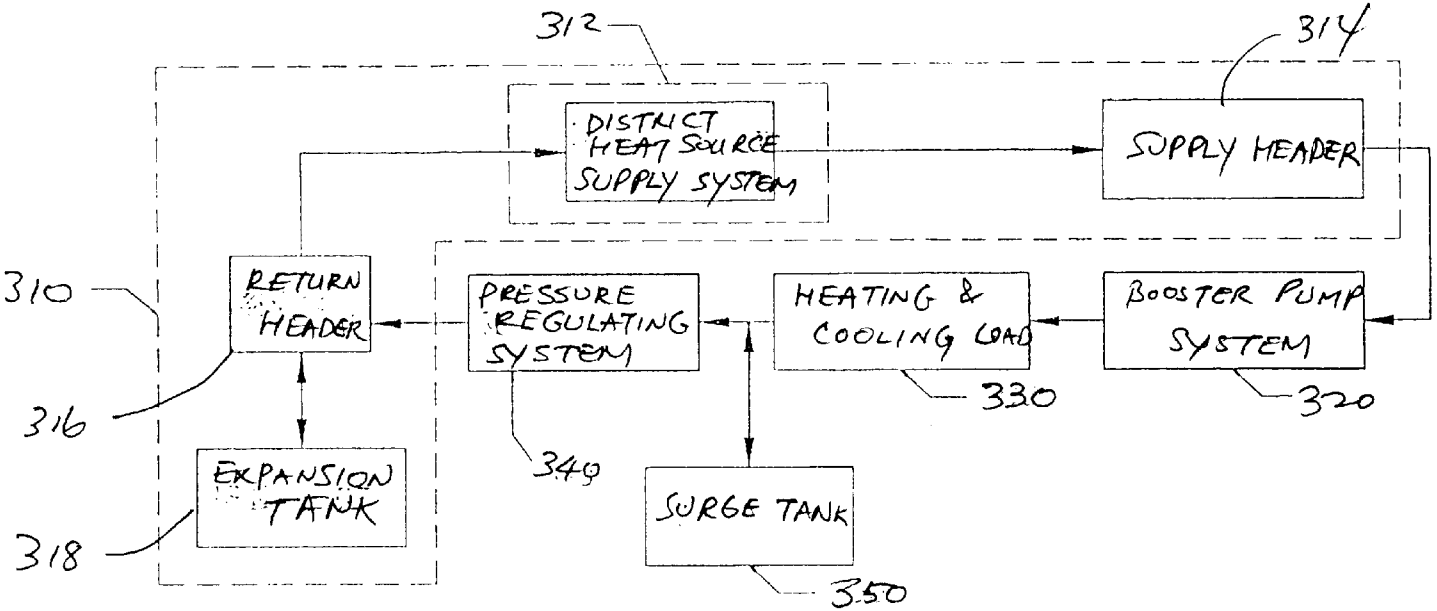
FIG. 3 is a block diagram showing thermo-fluid circulation within heating and air conditioning piping units of the present invention.

FIG. 3 illustrates a block diagram of a multi-stage pressure distribution and regulation system 300 according to an embodiment of the invention where the district heat source supply system is used as the heat source supply system. In the illustrated embodiment, the piping system is configured such that a machine room 310 receives thermo-fluid from the district heat source supply system 312 and transmits the fluid to a booster pumping system 320 via supply header 314. The thermo-fluid returned and collected via heating and cooling loads 330 is transmitted back to the district heat supply system 312 through a pressure regulating system 340 and a return header 316. A surge tank 350 and an expansion tank 318 are used to appropriately adjust pressure in the pipe.

Referring back to FIG. 2, the booster pumping system 220 and the pressure regulating system 230 are configured to be vertically zoned in multiple stages. The systems 220, 230 perform pressure control at each stage according to the head pressure of the building. For example, since the height of each floor is about 4.0 to 4.5 m, when the pressure control range of each booster pumping stage 222, 224, or 226 is maintained at 7 to 25 kg/cm$^2$ for safety and economic efficiency, the head pressure generated (when each stage zoned in the building is composed of twenty stories) is typically in the order of about 8 to 10 kg/cm$^2$. Accordingly, the booster pumping system 220 is constructed such that booster pumps (PP2) are installed at respective areas to circulate and supply the thermo-fluid to control the head pressure in a pressure range for safe use.

The booster pumping system 220 includes booster pumps (PP2) and pump control valves (PCV2) connected to the booster pumps (PP2) in series. The booster pumping system 220 operates to prevent a surging phenomenon during start and stop cycles of the booster pumps (PP2). The system 220 also operates to substantially instantly close the valve to prevent thermo-fluid backflow during electrical outage. This allows optimal control of the system 220 by minimizing pressure fluctuation during operation of the pumps. Furthermore, the booster pumping system 220 includes pressure relieving and sustaining valves (RSV2) coupled to the booster pumps (PP2) and pump control valves (PCV2) in parallel to maintain pressure. The pressure is changed when 2-way valves (V2) of the heating and cooling loads 210 are opened and closed at a predetermined pressure irrespective of an inlet side potential or flow rate changes required for the system 220. In some embodiments, a check valve (not shown) may be installed on a lower end of each booster pump (PP2). This prevents pressure on the upstream side (with respect to the booster pump (PP2)) from acting on the downstream side, such that at termination of the booster pump (PP2) excessive water pressure cannot act on the system 220.

In one embodiment, a surge tank 250 is installed on the topmost portion of the return piping system. The surge tank 250 functions to adjust pressure fluctuation factors, which are generated when pressure control devices are opened or closed at different times by means of a pressure relief valve (RV) or a check valve. The surge tank 250 also prevents surge action when the control valves are rapidly closed. Furthermore, the surge tank 250 functions as a water supply tank, and relieves pressure in the system by opening the pressure relief valve (RV) when rapid pressure expansion is generated. When the pumps stop pumping, the mechanical check valves of the booster pumps are closed so that the upstream side pressure does not act on the downstream side of the pumps.

If a carbon steel pipe for pressure service is used as a pipe for supply piping of a circulation supply piping line, the height of each of the vertically zoned areas may be increased. Hence, the height of each vertically zoned area may be increased such that the head pressure is larger than the head pressure of 5 to 25 kg/cm$^2$ within the pressure range for safe use of the piping line and the pumps. This allows the number of and installation space for machine facilities such as booster pumps to be substantially reduced. Further, the head pressure within the piping system for the heating and cooling load at each zoned area is maintained at an appropriate pressure for safe use of equipment (1 to 10 kg/cm$^2$). Since there is downward flow in a water return piping, the pressure regulating system prevents creation of negative pressure due to water falling and allows reduction of the high head pressure.

A head pressure control device performs pressure reduction and backflow prevention such that the main valve is closed when the upstream side pressure becomes lower than a predetermined pressure, and when the downstream side pressure becomes higher than a predetermined pressure. Thus, the pressure regulating system 230 enables stable maintenance of thermo-fluid pressure within the design range. In one embodiment, the pressure regulating system 230 for meeting the above requirements may be constructed as as described below.

The pressure regulating system 230 includes pressure reducing and sustaining devices (PRSD). Each pressure reducing and sustaining device (PRSD) reduces a high pressure of an inlet side (i.e., upstream side) to a low pressure of an outlet side (i.e., downstream side), and accurately maintains a predetermined outlet pressure irrespective of a change in the inlet side pressure or a flow rate. The valve is closed when the outlet side pressure becomes higher than the predetermined pressure as well as when the inlet side pressure becomes lower than the predetermined pressure.

Since the pressure regulating system 230 is vertically zoned in multiple stages to reduce the pressure of thermo-fluid, the occurrence of cavitation may be avoided. The control range of the head pressure in the pressure regulating system 230 is 5 to 25 kg/cm$^2$ similar to that of the booster pumping system 220. This range is desirable in view of the stability and economic efficiency. Further, since the heat source supply system 240, the first-stage booster pumping system 222, and the first-stage pressure regulating system 232 may be installed on the basement floor of the building (a machine room 260), installation floor is substantially reduced.

In the illustrated embodiment, an air- or nitrogen-pressurized diaphragm type closed expansion tank (ET) 242 is installed in the machine room 200 to absorb and regulate pressure fluctuation during operation of the pumps or due to hunting and offset phenomena of the pressure reducing and sustaining valves. Further, a flow meter (M) for measuring the flow rate of the returned thermo-fluid may be installed in the machine room. The flow meter (M) is typically coupled to a flow detector (not shown). Thus, signals generated from the detection of the flow meter (M) may be inputted into a system control panel.

Detailed characteristics of the components of the multi-stage pressure distribution and regulation system 200 is described below.

(1) Pressure Reducing and Sustaining Device

Figure 4:
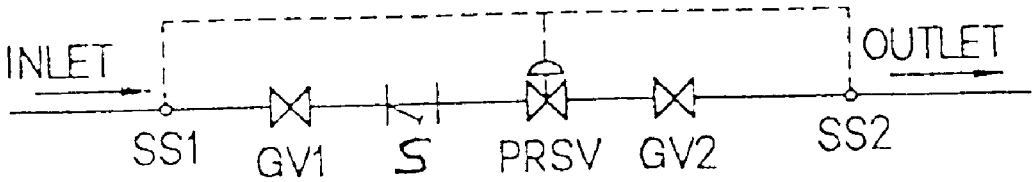
FIG. 4 is a block diagram showing thermo-fluid circulation within heating and air conditioning piping units of the present invention in a case where a district heat source supply system is employed as a heat supply means.

Each pressure reducing and sustaining device (PRSD) performs two independent functions—(a) reducing high pressure of the inlet side (upstream side) to a low pressure of the outlet side; (b) appropriately maintaining the predetermined outlet side pressure irrespective of the change in the inlet side pressure or the flow rate. For example, in FIG. 4, a first pressure sensor (SS1), a second pressure sensor (SS2), a first service valve (GV1), a second service valve (GV2), and a strainer (S) are coupled with a pressure reducing and sustaining valve (PRSV) to form a pressure reducing and sustaining device. This device maintains the inlet side pressure at a predetermined pressure, and also maintains the outlet side pressure, which is a reference pressure, at the same predetermined pressure. Thus, when the inlet side pressure becomes lower, the lowered pressure is sensed by the first pressure sensor (SS1), and the pressure reducing and sustaining valve (PRSV) is automatically closed through pilot control. Then, the inlet side pressure is raised until a predetermined pressure is reached and maintained. If the outlet side pressure becomes higher due to added pressure or returned pressure, the higher pressure is sensed by the second pressure sensor (SS2). In response, the pressure reducing and sustaining valve (PRSV) is closed to prevent the backflow.

In constructing the pressure reducing and sustaining device according to the above described embodiment, it is desirable to have the pressure reducing and sustaining valves coupled with each other in parallel as described below.

When various changes in the flow rate are required, if one valve is selected for a relatively large flow rate, this valve may meet both small and large flow rate while reducing the pressure to a desired pressure. When a relatively small flow rate is required, a valve seat may be opened only a short duration, and then, immediately closed. However, if this process is repeated, a chattering phenomenon as well as excessive wear may occur, and may lead to noise generation. The noise problem may be solved by installing two valves in parallel (i.e., one with a large-diameter valve and another with a small-diameter valve). An additional valve may be separately installed as a spare part to enhance stability.

(2) Pressure Relieving and Sustaining Valves

The pressure relieving and sustaining valves (RSV1, RSV2) serve to maintain the predetermined inlet side pressure at a constant value irrespective of the change in inlet side potential or the flow rate required by the system. The valves also function to alleviate a load by bypassing a portion of the pressure so that only constant pressure may be supplied.

(3) Pump Control Valves

The pump control valves (PCV1, PCV2) function to eliminate the surging phenomenon within the piping system generated the start/stop operation of the pump. The valves are installed in the discharge side piping of the booster pump (PP2) and the first circulation pump (PP1) to control discharge pressure. When the pump starts in a state where the valves are closed, electricity is supplied from a power source to an electronic control valve for pilot, and then, the valves are slowly opened. The thermo-fluid in the piping is then gradually raised to a suction lift of the pump. When a stop signal is transmitted to the pump, the electricity supplied from the power source to the electronic control valve for pilot is cut off. Then, the valves are slowly closed, and thus, the flow rate is gradually reduced. When the valves are closed, a limit switch for electrically interlocking the pump with the valves is operated to cut off the electricity to the pump, which stops the pump. If the electricity is suddenly cut off (power failure), thermo-fluid flow stops at a moment when a check valve contained in the pump is closed. The check valve is closed irrespective of the position of the solenoid or diaphragm in order to prevent backflow.

(4) Booster Pumps

The booster pumps (PP2) are coupled with each other in series in a multi-stage manner, if necessary, in order to supply the thermo-fluid in the supply piping to a higher position. The booster pump at each stage is constructed by connecting two or more pumps having rated capacity in parallel so as to control the number of pumps to be operated by the system control panel depending on values measured by the flow meter. Accordingly, since the booster pumps may be controlled in response to various changes in the flow rate, energy consumption may be reduced. The vertical height (pressure range) of each zoned area is determined in consideration of pressure resistance strength and characteristics of the piping and equipment and the like.

The booster pump may be operationally controlled so that energy consumption may be reduced by controlling the number of pumps to be operated, by controlling the number of rotations (i.e., variable flow rate control), or by stopping the pumps in response to the pressure in the system and controlling the number of pumps to be operated depending on the load.

(5) Expansion Tank

The expansion tank (ET) is provided for a water return header of the heat source supply system to absorb, relieve and regulate expansion pressure. In some embodiments, an air- or nitrogen-pressurized closed tank is used. Auxiliary equipment such as an air compressor, a relief valve, a supplementary water line and an alarm device may be provided thereto.

(6) Surge Tank

The surge tank (ST) prevents the surging phenomenon due to rapid changes in the flow rate or velocity during operation of the system. The tank opens the pressure relief valve (RV) or safety valve to drop the pressure in response to rapid pressure changes. A check valve (CV) functions to prevent backflow, and also functions as a supplementary water tank.

Figure 5:
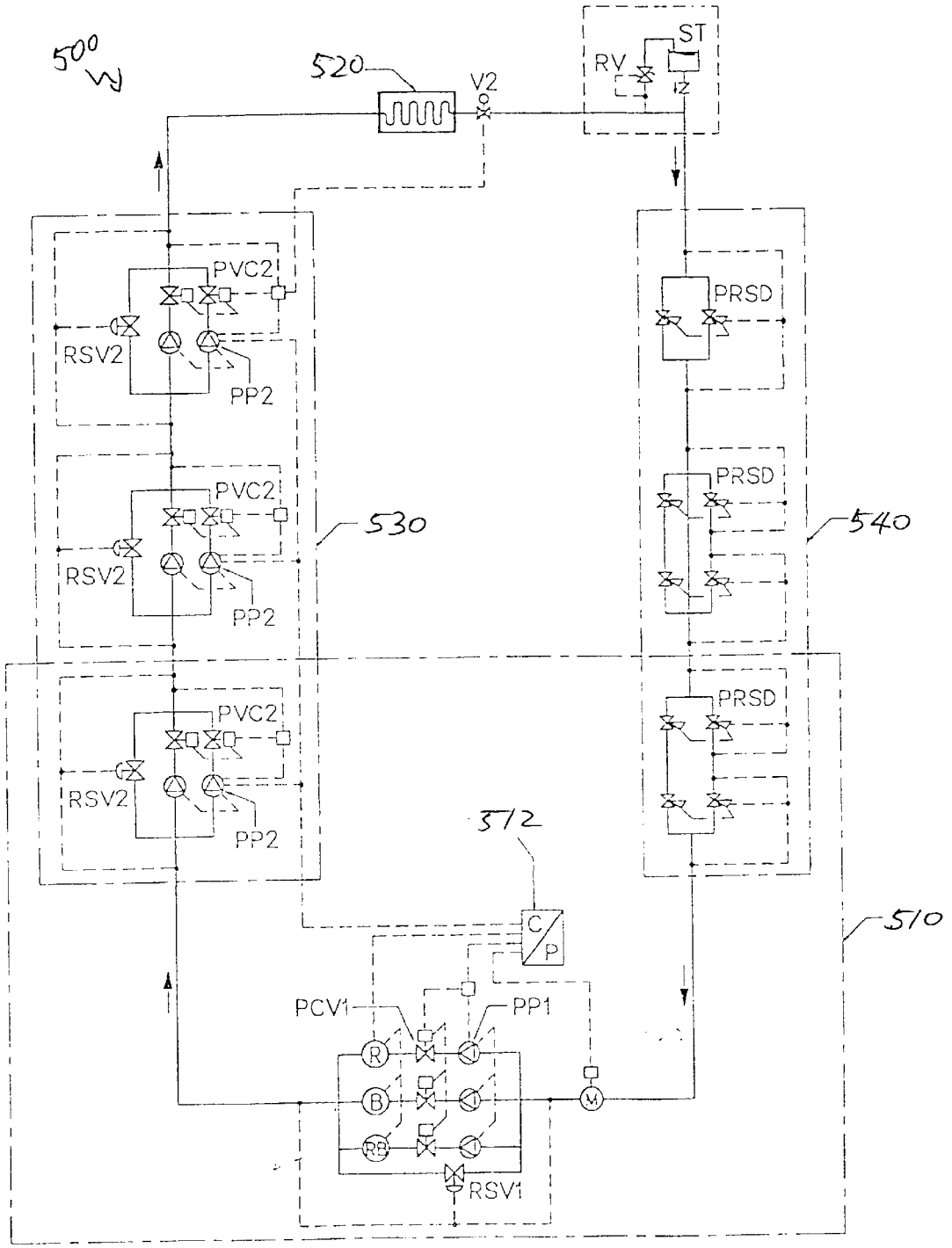
FIG. 5 is a schematic view showing the constitution of a pressure reducing and sustaining device provided for a pressure regulating system according to the present invention.

FIG. 5 illustrates a thermo-fluid circulation process in the multi-stage pressure distribution system 500 according to an embodiment of the invention. The process includes maintaining the pressure in the machine room 510 at a constant value. The system control panel 512 is then commanded to sequentially operate the first circulation pump (PP1), the booster pumps (PP2) at each stage, and thermal equipment (R, B, RB). In order to supply the thermo-fluid to be used in the heating and cooling loads 520, the system control panel 512 is operated so that the first circulation pump (PP1) and booster pumps (PP2) may be driven. The first circulation pump (PP1) is driven so that the thermo-fluid may be transferred to the booster pumping system 530 via the thermal equipment (R, RB, B). The respective booster pumps (PP2) of the first, second, and third stages of the booster pumping system 530 are operated so that the thermo-fluid may be transferred to the respective heating and cooling loads 520 via the pump control valves (PCV2).

The number of booster pumps (PP2) to be operated at each stage is controlled by the system control panel 512 depending on the load and the changes in the flow rate. The pressure generated at the termination of the pumps is controlled by the control function of the sequential pump control valves (PCV2) to ensure silent operation of the system.

When the 2-way valve (V2), provided for the heating and cooling load 520, is closed due to a change in the load, the pressure in the water supply piping is raised. The raised pressure is then controlled by the control function of the booster pumping system 530. The pressure relieving and sustaining valves (RSV2) serve as emergency and complementary devices. Further, upon generation of unusual pressure, the pressure relief valve (RV) or safety valve of the surge tank (ST) is operated at the topmost portion of the piping system for the respective stages.

The pressure of the thermo-fluid which has passed through the heating and cooling load 520 is reduced via the multi-stage pressure regulating system 540 which is installed at areas vertically zoned according to the height of the building. Thus, the thermo-fluid circulates to maintain the pressure in the machine room 510 at a constant value.

The head pressure in the respective stages of the pressure regulating system 540 is set in the order of the predetermined pressure range (5 to 25 kg/cm$^2$) at the vertically zoned areas as described above in consideration of economic efficiency and safety. The operational pressure may be set to a value higher than the head pressure generated upon termination of the pump by 2 to 3 kg/cm$^2$. Further, the pressure fluctuation due to the hunting and offset phenomena of the pressure reducing and sustaining valves (PRSV) is absorbed and regulated by the expansion tank (ET) provided for the water return header.

Upon termination of the pump, the pump control valve is slowly closed, and the flow rate is reduced. This allows the pressure to drop. When the pressure in the system continues to drop and becomes lower than the predetermined pressure of the water return side pressure sustaining valve, the valve is automatically closed to maintain a hydrostatic head pressure. When the valve is completely closed, a limit switch is operated to stop the booster pumps.

Embodiments of the present invention provide several advantages. Firstly, the head pressure at each area may be controlled within a predetermined range for safe use because the entire heating and cooling load is divided into vertically zoned area depending on the generated head pressure proportional to the height of the building. Hence, the embodiments of the invention may be applied to any building regardless of the height. Secondly, heavy thermal equipment, such as a refrigerator, a heat exchanger and/or a boiler, which has typically been installed in the intermediate floors or the rooftop, has been shown in the illustrated embodiments to be capable of operating in the basement of the building. Therefore, a lightweight building material may be used in construction. Furthermore, noise, vibration, and fire may substantially be reduced in the building. Thirdly, since thermo-fluid is transferred directly to the heating and cooling loads from the basement floor of the building through the piping system, heat loss may be minimized. This increases the heat transfer efficiency, and thus, saves energy. Further, since the thermal equipment may be centralized and managed in the basement floor of the building, the operation and management of the heating and air conditioning system becomes easier and less costly.

There has been disclosed herein alternative embodiments for distributing and regulating pressure in the piping units of thermal equipment in high-rise buildings. In particular, the pressure in the piping units is stably maintained at a relatively constant value at substantially all floors of the building. Furthermore, the piping units are configured into vertically-zoned areas so that the pressure may be appropriately controlled within a certain range.

While specific embodiments of the invention have been illustrated and described, such descriptions have been for purposes of illustration only and not by way of limitation. Accordingly, throughout this detailed description, for the purposes of explanation, numerous specific details were set forth in order to provide a thorough understanding of the present invention. It will be apparent, however, to one skilled in the art that the embodiments may be practiced without some of these specific details. For example, although the embodiments have been described in terms of three stages of the zoned areas depending on the head pressure, any number of stages may be used to configure the pressure distribution and regulation system for a high-rise building. In other instances, well-known structures and functions were not described in elaborate detail in order to avoid obscuring the subject matter of the present invention. Accordingly, the scope and spirit of the invention should be judged in terms of the claims which follow.

What is claimed is:

1. A multi-stage pressure distribution and pressure regulation system, comprising:

at least one heating and cooling load having a supply side and a return side;

a heat source supply system for supplying thermo-fluid to the at least one heating and cooling load;

a booster pumping system including at least one booster pump for transferring the thermo-fluid from the heat source supply system to the supply side of the at least one heating and cooling load for maintaining a predetermined head pressure; and at least one pressure regulating system including at least one pressure reducing and sustaining device for reducing the pressure of the thermo-fluid flowing from the return side of the at least one heating and cooling load and sustaining the pressure at the predetermined head pressure; and a plurality of pump control valves coupled to the at least one booster pump to help maintain the predetermined head pressure.

2. The system of claim 1, wherein the at least one heating and cooling load is configured for areas vertically zoned depending on the head pressure.

3. The system of claim 2, wherein the heat source supply system is configured to supply the thermo-fluid to the at least one heating and cooling load for the vertically-zoned areas.

4. The system of claim 1, further comprising:

a pressure relieving and sustaining valve coupled to the at least one booster pump to allow the thermo-fluid pressure to exert only the predetermined pressure on the at least one booster pump.

5. The system of claim 1, further comprising:

a check valve coupled to a lower end of each booster pump to prevent pressure on the supply side from acting on the return side thereof upon termination of the booster pump.

6. The system of claim 1, wherein the at least one pressure reducing and sustaining device including at least one pressure reducing and sustaining valve.

7. The system of claim 6, wherein the at least one pressure reducing and sustaining device includes a plurality of sensor units to sense the thermo-fluid pressure and to maintain a constant pressure.

8. The system of claim 6, wherein the at least one pressure reducing and sustaining device includes a service valve.

9. The system of claim 6, wherein the pressure reducing and sustaining valve also includes a small-diameter pressure reducing and sustaining valve to bypass the thermo-fluid.

10. The system of claim 9, further comprising:

an expansion tank to absorb, relieve and regulate expansion pressure, so that pressure fluctuation occurring during operation of the pumps or due to hunting and offset phenomena of the pressure reducing and sustaining valve is absorbed and regulated.

11. The system of claim 1, further comprising:

a surge tank disposed at the top of a circulation line to communicate therewith the circulation line; and a pressure relief valve coupled to the surge tank to prevent abrupt pressure fluctuation within the system.

12. The system of claim 11, wherein the expansion tank is an air- or nitrogen-pressurized closed tank.

13. The system as claimed in claim 1, wherein the heat source supply system is an external district heat supply system to supply the thermo-fluid from an external source.

14. A high-rise building utilizing a multi-stage pressure distribution and regulation system, comprising:

at least one heating and cooling load having a supply side and a return side;

a heat source supply system for supplying thermo-fluid to the at least one heating and cooling load;

a plurality of pump control valves;

a booster pumping system including at least one booster pump for transferring the thermo-fluid from the heat source supply system to the supply side of the at least one heating and cooling load and the pump control valves for maintaining a predetermined head pressure; and at least one pressure regulating system including at least one pressure reducing and sustaining device for reducing the pressure of the thermo-fluid flowing from the return side of the at least one heating and cooling load and sustaining the pressure at the predetermined head pressure.

15. The high-rise building of claim 14, wherein each of the booster pumping systems further includes a pressure relieving and sustaining valves coupled to the booster pumps and the pump control valves to control the thermo-fluid pressure so that only a predetermined pressure is exerted on the booster pumps and the pump control valves.

16. The high-rise building of claim 14, wherein the at least one pressure reducing and sustaining device includes a pressure reducing and sustaining valve, pressure sensor units provided on inlet and outlet sides of the pressure reducing and sustaining valve for sensing the pressure of the thermo-fluid and for allowing control of maintenance of a constant pressure, and a service valve.

17. The high-rise building of claim 14, wherein the heat source supply system is an external district heat supply system to supply the thermo-fluid from an external source.

18. A multi-stage pressure distribution and pressure regulation system, comprising:

at least one heating and cooling load having a supply side and a return side;

a heat source supply system for supplying thermo-fluid to the at least one heating and cooling load;

a booster pumping system including at least one booster pump for transferring the thermo-fluid from the heat source supply system to the supply side of the at least one heating and cooling load for maintaining a predetermined head pressure;

at least one pressure regulating system including at least one pressure reducing and sustaining device for reducing the pressure of the thermo-fluid flowing from the return side of the at least one heating and cooling load and sustaining the pressure at the predetermined head pressure; and a check valve coupled to a lower end of each booster pump to prevent pressure on the supply side from acting on the return side thereof upon termination of the booster pump.

19. A method for distributing fluid pressure acting on piping units of a building, comprising:

providing booster pumps in multiple stages at appropriate intermediate floors of the building to build sufficient pressure on a supply side of heating and cooling loads; and providing pressure reducing valves in multiple stages at appropriate intermediate floors of the building to reduce the pressure on a return side of the heating and cooling loads.

20. A multi-stage pressure distribution and pressure regulation system, comprising:

at least one heating and cooling load having a supply side and a return side;

a heat source supply system for supplying thermo-fluid to the at least one heating and cooling load;

a booster pumping system including at least one booster pump for transferring the thermo-fluid from the heat source supply system to the supply side of the at least one heating and cooling load for maintaining a predetermined head pressure;

at least one pressure regulating system including at least one pressure reducing and sustaining device for reducing the pressure of the thermo-fluid flowing from the return side of the at least one heating and cooling load and sustaining the pressure at the predetermined head pressure; and a pressure relieving and sustaining valve coupled to the at least one booster pump to allow the thermo-fluid pressure to exert only the predetermined pressure on the at least one booster pump.

* * * * *